US011255642B1

(12) United States Patent
Rasico et al.

(10) Patent No.: US 11,255,642 B1
(45) Date of Patent: Feb. 22, 2022

(54) ARMORED VEHICLE CAB

(71) Applicant: Navistar Defense, LLC, Melrose Park, IL (US)

(72) Inventors: James Goodwin Rasico, Farmington, MI (US); Jeffrey Michael Fsadni, Royal Oak, MI (US); David Merill Gerst, Clarkston, MI (US); Anthony Scott Beggs, Allen Park, MI (US); Dale Scott Norman, Oxford, MI (US)

(73) Assignee: Navistar Defense, LLC, Lisle, IL (US)

( * ) Notice: Subject to any disclaimer, the term of this patent is extended or adjusted under 35 U.S.C. 154(b) by 0 days.

(21) Appl. No.: 17/065,207

(22) Filed: Oct. 7, 2020

(51) Int. Cl.
*F41H 7/04* (2006.01)
*F41H 5/013* (2006.01)

(52) U.S. Cl.
CPC ..... *F41H 7/044* (2013.01); *F41H 5/013* (2013.01)

(58) Field of Classification Search
CPC ..... F41H 7/044; F41H 5/013
USPC ..... 296/190.03
See application file for complete search history.

(56) References Cited

U.S. PATENT DOCUMENTS 5,663,520 A * 9/1997 Ladika ..... F41H 5/226 296/187.07
10,611,416 B1 * 4/2020 Groteleuschen ..... B62D 33/067
2008/0314236 A1 * 12/2008 Savage ..... F41H 5/226 89/36.02
2012/0005962 A1 * 1/2012 Ackermann ..... F41H 5/013 49/70
2012/0174766 A1 * 7/2012 Boczek ..... F41H 7/044 89/36.08

FOREIGN PATENT DOCUMENTS

AU 2011323795 A1 * 6/2013 ..... F41H 7/044
CA 2748512 A1 * 11/2010 ..... F41H 7/042
EP 3418247 B1 * 11/2019 ..... B66C 1/34

* cited by examiner

*Primary Examiner* — Samir Abdosh
(74) *Attorney, Agent, or Firm* — Paschall & Associates, LLC; James C. Paschall

(57) ABSTRACT

An armored vehicle cab with enhanced blast protection accomplished with wedge to wedge interfaces between the cab doors and the cab side walls that are approximately 90 degrees out of synch with each other to provide both fore/aft and vertical buffering of blast force applied to the cab floor in order to shift energy from cab door hinges to the wedges (and the structures to which they are mounted) which are in contact with each other. These enhancements will maintain door functionality post blast event (door will open and close).

8 Claims, 3 Drawing Sheets

ARMORED VEHICLE CAB

BACKGROUND

This disclosure relates to armored vehicles, specifically an armored passenger cab for such vehicles.

Armored military vehicles are built to withstand the forces generated from buried mines or Improvised Explosive Devices (IEDs). All aspects of the cab structure must meet challenging performance requirements to provide a fully capable system that protects the occupants from both the sudden acceleration of a blast event and potential exposure to enemy fire through a hull breach or failed closure. One of the areas needing enhanced structural capacity are the passenger and driver access doors of the armored vehicle. Specifically, the hinges on these doors are subject to high energy loads, exasperated by the significant weight of an up-armored door. During a blast event from a mine or an IED, the armored door's inertia resists motion as the blast impact rapidly accelerates the rest of the vehicle upward. The hinges take most of the load that is generated. A failure in the door hinge system can cause the door to disengage with the opening, leaving the occupants vulnerable to enemy attacks through the opening. This invention is meant to redirect the load that previously would be applied to the hinges, during a blast event, to be redistributed to other well-supported structures. By bolstering the hinges, the armored cab is able to maintain its integrity at higher loads, thereby protecting the occupants at higher blast levels.

SUMMARY

This disclosure involves an armored passenger cab for an armored vehicle. The armored vehicle cab includes cab side walls that are engaged at the front to a cab front wall and at the rear to a cab back wall. A cab floor is engaged to the cab side walls, the cab front wall, and the cab back wall. A cab roof is engaged to the top edges of the cab side walls, the cab front wall, and the cab back wall. The cab front wall contains a cab windshield that a driver of the vehicle can look through. Cab doors are engaged to the cab side walls through door hinges to encase the area that the driver and passengers sit during operation. The driver or passengers access the armored cab vehicle through operations to unlock the door latches and move the door about the door hinges. A door operating mechanism is engaged between the armored vehicle cab and the cab door to assist in moving the cab door. The cab floor contains cab mounting brackets for engaging the armored vehicle cab to a vehicle chassis. An inner portion of the cab doors contain mounting plates where the door hinges attach to armored door panels.

A blast door unsupported by wedges will tend to act as a lever arm during a blast event, because the hinges securely attach the front edge of the door and leave the rest of the door generally unsupported. This results in a relative rotation and motion of the bottom front corner of the door in the vertical and fore/aft directions. Even if the door is supported by latches (that don't fail in blast) at the opposite end, the elastic nature of the steel door will allow its center of mass to rotate down relative to the hinges and the latches. Although this motion is small, it is enough to cause shearing of hinge bolts, or failure of the hinge body. The enhanced blast protection of the armored vehicle cab is accomplished with wedge to wedge interfaces between the cab doors and the cab side walls that are approximately 90 degrees out of synch with each other to provide both fore/aft and vertical buffering of blast force applied to the cab floor. This is accomplished as follows.

The armored vehicle cab has a cab door opening with the cab door mounted adjacent to the cab door opening to seal the cab door opening when the cab door is closed. The cab door opening is partially defined by a cab door opening lower edge. The cab door opening lower edge has a lower edge wedge bracket welded to it. The lower edge bracket is a solid block with a machined flange interfacing with a slot in the body side panel at the bottom edge of the door opening. The lower edge bracket has a lower cab wedge engaged to it at a lower edge wedge bracket engagement surface. The cab door has a cab door lower edge. The cab door lower edge has a lower door wedge engaged to it at the lower edge wedge engagement surface. The lower cab wedge and the lower door wedge are adjacent or in contact when the cab door is closed. The wedges are of consistent length and width. The thickness of the wedges is greater on one side than the other side. The thicker side of the lower edge cab wedge is immediately adjacent to the lower door wedge thinner side, and vice versa in this door closed condition. During a blast event the wedge faces are in contact with one another and prevent vertical motion of the door. Instead, the interaction of these wedges provides an alternative load path between the door and the door opening during a blast event. This results in load transfer through the door and body panel rather than the hinges.

Fore/aft motion support of the hinges during blast events is provided by another set of wedges. The cab door opening is partially defined by the cab door opening front side edge. The cab door opening front side edge has a front edge wedge bracket welded to it. The front edge wedge bracket is a solid block with a machined flange interfacing with a slot in the body side panel at the side edge of the door opening. The front edge wedge bracket has a side edge cab wedge mounted to it at a front edge wedge bracket engagement surface. The cab door has a cab door front side edge. The cab door front side edge has a side door wedge engaged to it at the front edge wedge engagement surface. The side edge cab wedge and the side door wedge are adjacent or in contact when the cab door is closed. The wedges are of consistent length and width. The thickness of the wedges is greater on one side than the other. The thicker side of the side door wedge is immediately adjacent to the side edge cab wedge thinner side, and vice versa in this door closed configuration. The interaction of these wedges provides a fore/aft load path during blast events as the wedges move against each other.

The location of the wedge pairs in the vicinity of the hinges, reduces the force applied to the hinges during a blast event.

The foregoing summary, accompanied by further detail of the disclosure, will be presented in the Detailed Description below with reference to the following drawings that are part of this disclosure.

DETAILED DESCRIPTION

Figure 1:
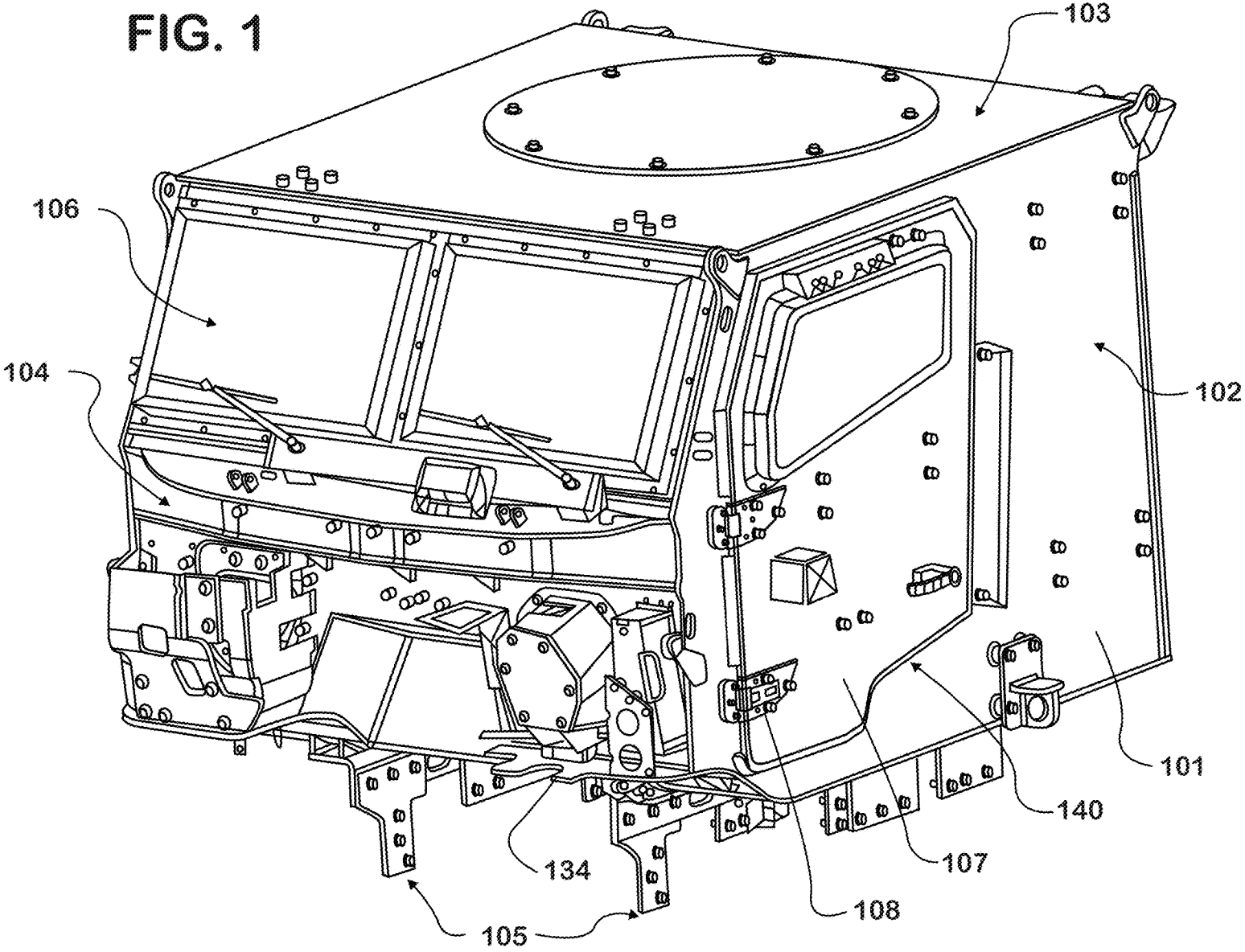
FIG. 1 is a perspective diagram of an armored vehicle cab.
Figure 2:
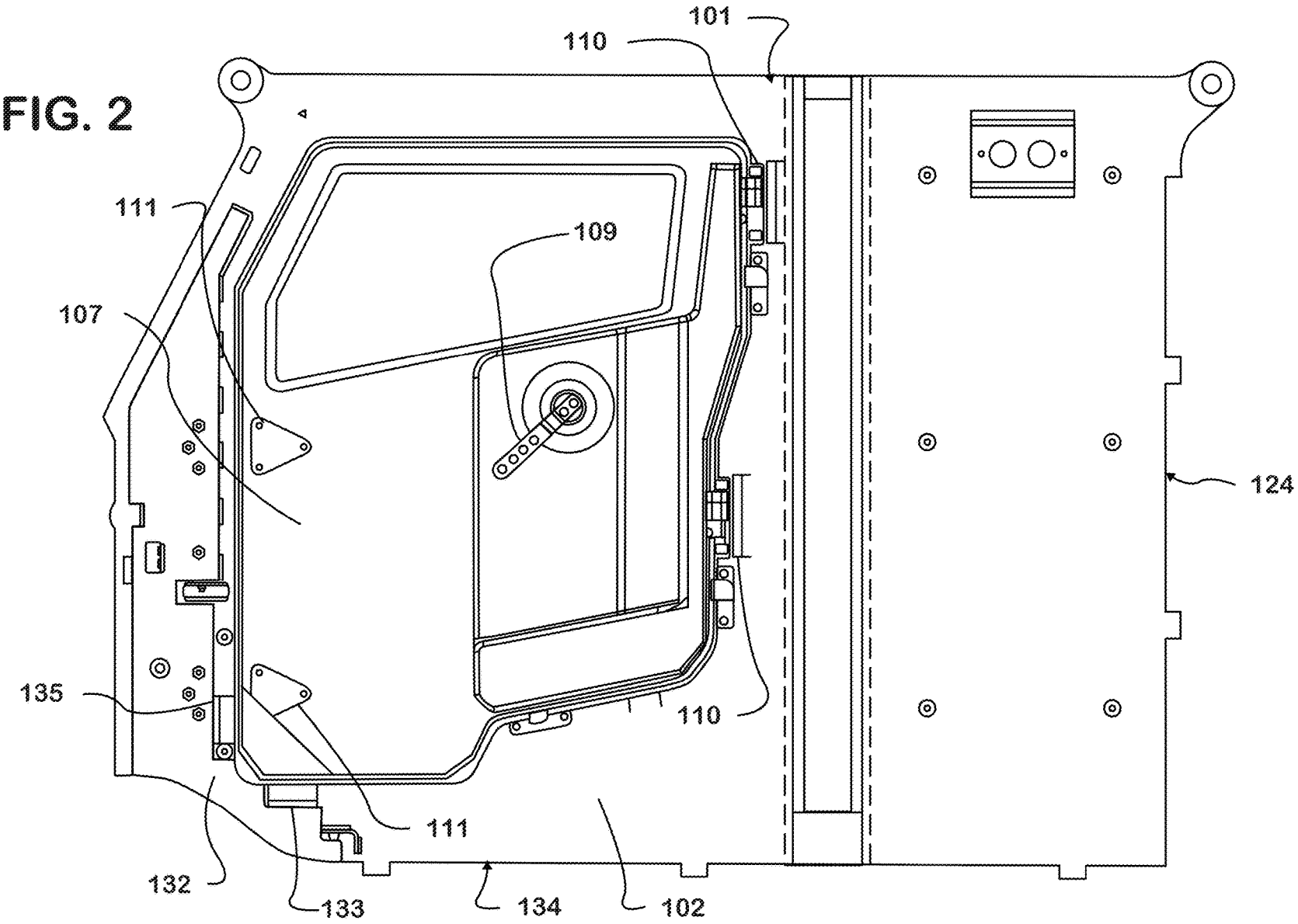
FIG. 2 is a side interior view of FIG. 1.
Figure 4:
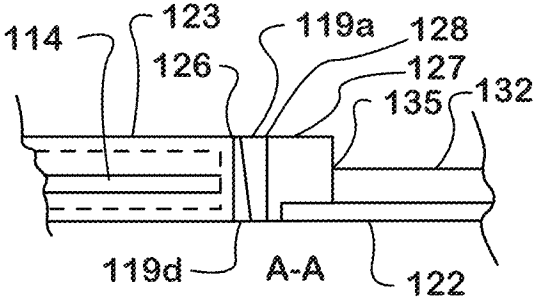
FIG. 4 is a cross section A-A view from FIG. 3

FIG. 1 shows an armored vehicle cab 101 for an armored vehicle. The armored vehicle cab 101 includes cab side walls 102 that are engaged at the front to a cab front wall 104 and at the rear to a cab back wall 124 shown in FIG. 2. A cab floor 134 is engaged to the cab side walls 102, the cab front wall 104, and the cab back wall 124. A cab roof 103 (labeled as 101 in FIG. 2) is engaged to the top edges of the cab side walls 102, the cab front wall 104, and the cab back wall 124, as shown in FIG. 2. The cab front wall 104 contains a cab windshield 106 that a driver of the vehicle can look through. Cab doors 107 are engaged to the cab side walls 102 through door hinges 108 to enclose the area that the driver and passengers sit during operation. The driver or passengers accessing the armored passenger cab 101 through operations releasing door latches 110 to move the door about the door hinges 108. A door operating mechanism 109, shown in FIG. 2, is engaged between the armored vehicle cab 101 and the cab door 107 to assist in moving the cab door 107. The cab floor 134, as shown in FIGS. 1 and 2, contains cab mounting brackets 105 for engaging the armored vehicle cab 101 to a vehicle chassis. An inner portion of the cab doors 107 contain door hinge mounting plates 111 which attach the hinges 108 to the door 107.

The enhanced blast protection of the armored vehicle cab 101 is accomplished with a pair of wedge to wedge interfaces between the cab doors 107 and the cab side walls 102 that are approximately 90 degrees out of synch with each other to provide both fore/aft and vertical buffering of the blast force applied to the cab floor 134. The wedges 119*a*, 119*b*, 119*c*, and 119*d* can be of different types of material, but they are made of a hard plastic in the preferred embodiment. Blast protection enhancement is accomplished as follows.

The armored vehicle cab 101 has a cab door opening 140 with the cab door 107 mounted adjacent to the cab door opening 140, shown in FIG. 1. to seal the cab door opening 140 when the cab door 107 is closed. FIGS. 3, 4, 5, and 6 help further illustrate the design. The cab door opening 140 is partially defined by a cab door opening lower edge 112. The cab door opening lower edge 112 has a lower edge wedge bracket 117 welded to it. The lower edge bracket 117, is a solid block with a machined flange interfacing with a slot 133 in a body side panel 132. See FIG. 7 for the lower edge bracket 117 shown individually. The lower edge bracket 117 has a lower cab wedge 119*a* engaged to it at a lower edge wedge bracket engagement surface 118. The cab door 107 has a cab door lower edge 113. The cab door lower edge 113 has a lower door wedge 119*b* engaged to it at the lower edge wedge engagement surface 116. The lower cab wedge 119*a* and the lower door wedge 119*b* are adjacent or in contact when the cab door 107 is closed. Per FIG. 6, the wedges 119*a*, 119*b*, 119*c*, and 119*d* are of consistent length L and width W. The thickness of the wedges is greater on one side T1 than the other side T2. The thicker side of the lower edge cab wedge T1 is immediately adjacent to the lower door wedge thinner side T2, and vice versa in this door 107 closed configuration. The interaction of these wedges provides a vertical load path through the wedges 119*a*, and 119*b* during blast events as the wedges 119*a*, and 119*b* come into contact and move against each other. This results in load transfer through the door and body panel rather than the hinges 108.

There is a door front to bottom support bracket 114 between the cab door lower edge 113 and a cab door front side edge 123. The door front to bottom support gusset 114 provides additional stability to the door 107.

Figure 6:
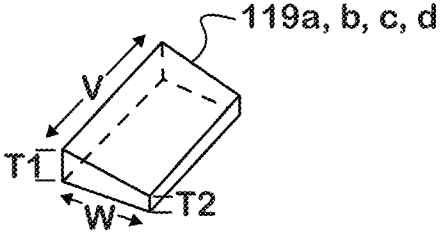
FIG. 6 is a view of a wedge shown in FIGS. 3, 4, and 5
Figure 5:
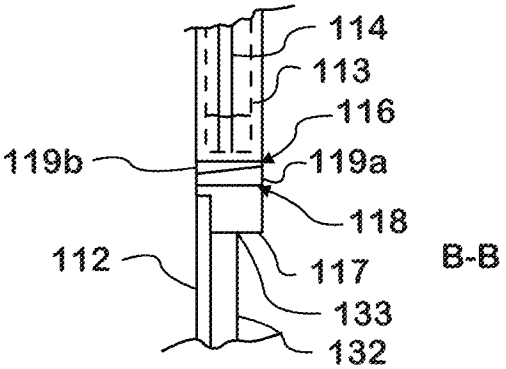
FIG. 5 is cross section B-B view from FIG. 3.
Figure 7:
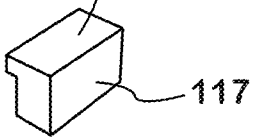
FIG. 7 is a view of a lower edge wedge bracket shown in 3 and 5.
Figure 3:
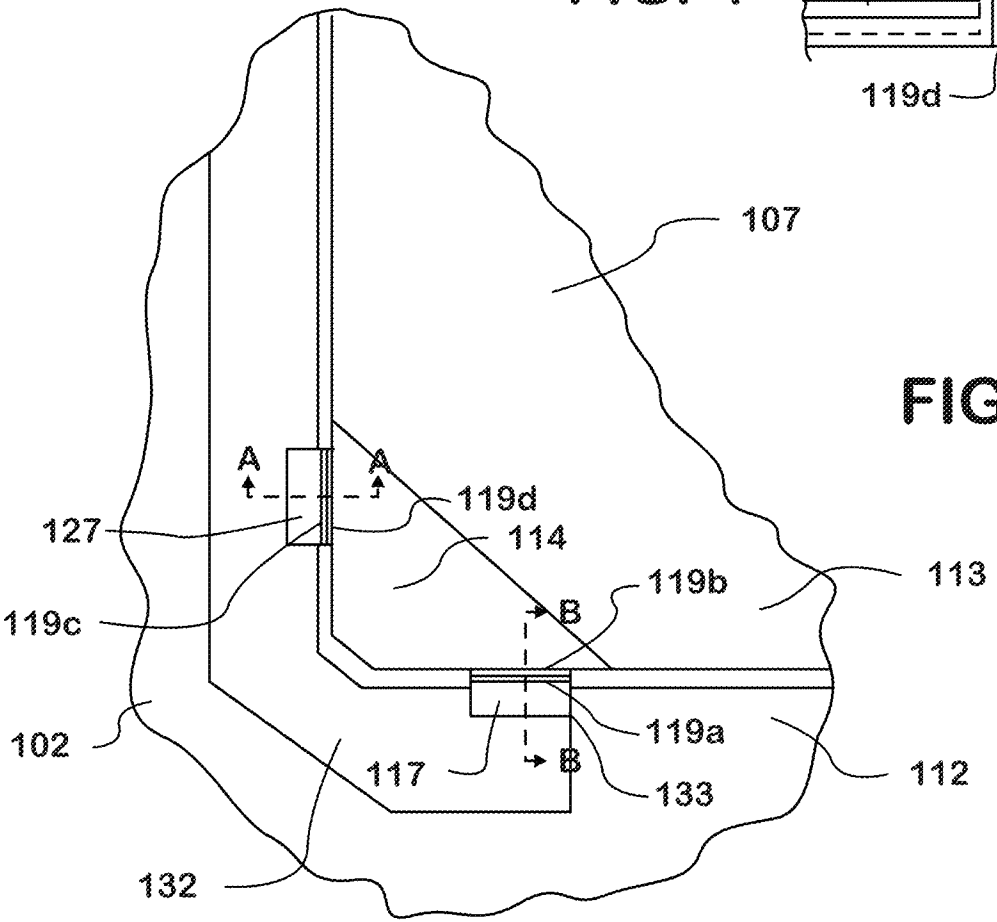
FIG. 3 is an enlarged view of the front side corner of FIG. 2.

Fore/aft motion support during blast events is provided by another set of wedges 119*c* and 119*d*. The cab door opening 140 is partially defined by the cab door opening front side edge 122. The cab door opening front side edge 122 has a front edge wedge bracket 127 engaged to it. The front edge wedge bracket 127 is a solid block with a machined flange interfacing with a slot 135 in the body side panel 132. The lower edge wedge bracket 127 is similar in shape as the lower edge bracket 117 shown in FIG. 7. It allows engagement of the cab door opening front side edge 122. The front edge wedge bracket 127 has a side edge cab wedge 119*c* attached to it at a front edge wedge bracket engagement surface 128. The cab door 107 has a cab door front side edge 123. The cab door front side edge 123 has a side door wedge 119*d* engaged to it at the front edge wedge engagement surface 126. The side edge cab wedge 119*c* and the side door wedge 119*d* are adjacent or in contact when the cab door 107 is closed. The wedges 119*c* and 119*d* are of consistent length L and width W as shown in FIG. 6. The thickness of the wedges is greater on one side than the other. The thicker side T1 of the side door wedge is immediately adjacent to the side edge cab wedge thinner side T2, and vice versa in this door closed configuration. The interaction of these wedges 119*c* and 119*d* provides an additional fore/aft load path during blast events as the wedges move against each other, alleviating loads on the hinge (and hinge bolts).

The wedge pair comprised of lower door wedge 119*a* and the lower door wedge 119*b* provide an alternative vertical load path, and the wedge pair comprised of the lower door wedge 119*c* and the lower door wedge 119*d* provide a fore/aft load path that reduces the forces applied to the door hinges 108 during a blast event below the cab floor 134. An important element is that the wedge pairs are aligned approximately 90 degrees apart.

As described above, the armored vehicle cab 101 of this disclosure provides a number of advantages, some of which have been described above and others of which are inherent in the disclosure. Also, modifications may be proposed to the armored vehicle cab of this disclosure without departing from the teachings herein.

What is claimed is:

1. An armored vehicle passenger cab, comprising:

cab side walls engaged at a front to a cab front wall and at a rear to a cab back wall;

a cab floor is engaged to the cab side walls, the cab front wall, and the cab back wall;

a cab roof is engaged to top edges of the cab side walls, the cab front wall, and the cab back wall;

the cab front wall containing a cab windshield;

cab doors engaged to the cab side walls through door hinges to encase an area that the driver and passengers sit during vehicle operation;

the cab floor containing cab mounting brackets for engaging the cab floor to a vehicle chassis;

a cab door opening partially defined by a cab door opening lower edge;

the cab door opening lower edge being engaged to a lower edge wedge bracket;

the lower edge wedge bracket having a lower cab wedge engaged;

the cab door having a cab door lower edge;

the cab door lower edge engaged to a lower door wedge;

the lower cab wedge and the lower door wedge being in contact when the cab door is in a closed position, and forming a lower wedge pair;

a cab door opening front side edge being engaged to a front edge wedge bracket;

the front edge wedge bracket being engaged to a side edge cab wedge;

the cab door having a cab door front side edge;

the cab door front side edge being engaged to a side door wedge; and the side edge cab wedge and the side door wedge being in contact when the cab door is in a closed position, and the side edge cab wedge and the side door wedge forming a side wedge pair.

2. The armored vehicle passenger cab as set forth in claim 1 further comprising:

the lower wedge pair and the side wedge pair are of consistent length and width;

one side of wedges having a thickness being thicker on one side than a thinner opposite side;

the thicker side of the wedge being immediately adjacent to an opposing wedge thinner side of each wedge pair, and vice versa in a door closed condition; and during a blast event interaction of the wedge pairs providing alternative vertical and fore and aft load paths as the wedge pairs come into contact and move against each other, reducing loads on the door hinges that could lead to structural failure.

3. An armored vehicle passenger cab, comprising:

cab side walls engaged at a front to a cab front wall and at a rear to a cab back wall;

a cab floor is engaged to the cab side walls, the cab front wall, and the cab back wall;

a cab roof is engaged to top edges of the cab side walls, the cab front wall, and the cab back wall;

cab doors engaged to the cab side walls through door hinges to encase an area that the driver and passengers sit during vehicle operation;

a cab door opening partially defined by a cab door opening lower edge;

the cab door opening lower edge being engaged to a lower cab wedge;

the cab door having a cab door lower edge;

the cab door lower edge engaged to a lower door wedge;

the lower cab wedge and the lower door wedge being in contact when the cab door is in a closed position, and forming a lower wedge pair;

the lower wedge pair providing a load path away from the door hinges in the event of a blast event below the cab floor; a cab door opening front side edge being engaged to a side edge cab wedge;

the cab door having a cab door front side edge engaged to a side door wedge;

the side edge cab wedge and the side door wedge being in contact when the cab door is in a closed position, and the side edge cab wedge and the side door wedge forming a side wedge pair; and the side wedge pair providing a load path that reduces fore and aft loading at the door hinges in the event of a blast event below the cab floor.

4. The armored vehicle passenger cab as set forth in claim 3 further comprising:

the lower door wedge being engaged to the door lower edge through a lower edge bracket at a lower edge wedge bracket engagement surface.

5. The armored vehicle passenger cab as set forth in claim 4 further comprising:

the lower edge bracket being a solid block with a machined flange interfacing with a slot in a body side panel engaged to the cab side wall.

6. The armored vehicle passenger cab as set forth in claim 5 further comprising:

the lower wedge pair and the side wedge pair are of consistent length and width;

one side of wedges having a thickness being thicker on one side than a thinner opposite side;

the thicker side of the wedge being immediately adjacent to an opposing wedge thinner side of each wedge pair, and vice versa in a door closed condition.

7. The armored vehicle passenger cab as set forth in claim 6 further comprising:

the side edge cab wedge being engaged to the cab door opening front side edge through a front edge wedge bracket at a front edge wedge bracket engagement surface.

8. The armored vehicle passenger cab as set forth in claim 7 further comprising:

the front edge wedge bracket being a solid block with a machined flange interfacing with a slot in a body side panel engaged to the cab side wall.

* * * * *